United States Patent [19]

Augustin

[11] Patent Number: 4,841,261

[45] Date of Patent: Jun. 20, 1989

[54] MICROWAVE ROTARY JUNCTION WITH EXTERNAL ROTARY ENERGY COUPLING

[76] Inventor: Eugene P. Augustin, 2713 Lemon Tree La., Orlando, Fla. 03209

[21] Appl. No.: 91,710

[22] Filed: Sep. 1, 1987

[51] Int. Cl.[4] ..... H01P 1/06

[52] U.S. Cl. ..... 333/21 A; 333/26; 333/260; 333/261; 343/763

[58] Field of Search ..... 333/21 A, 245, 249, 333/256, 257, 260, 261, 24 C, 26, 33; 343/757, 763, 766

[56] References Cited

U.S. PATENT DOCUMENTS

| | | | |
|---|---|---|---|
| 2,473,443 | 6/1949 | Ragan | 333/256 X |
| 2,520,945 | 9/1950 | Marindin | 333/261 X |
| 2,743,422 | 4/1956 | Muchmore | 333/245 |
| 2,784,383 | 3/1957 | Zaleski | 333/261 |
| 2,880,399 | 3/1959 | Murphy | 333/21 R X |
| 2,993,140 | 7/1961 | Westbrook | 333/249 X |
| 3,245,013 | 4/1966 | Forge | 333/260 X |
| 3,975,695 | 8/1976 | Hartman | 333/249 X |
| 4,071,833 | 1/1978 | Gould | 333/33 |
| 4,414,516 | 11/1983 | Howard | 333/21 A |
| 4,503,379 | 3/1985 | Raiman | 333/21 A |
| 4,504,836 | 3/1985 | Seavey | 333/21 A X |
| 4,528,528 | 7/1985 | Augustin | 333/21 A |
| 4,544,900 | 10/1985 | Howard | 333/21 A |
| 4,652,841 | 3/1987 | Hudspeth et al. | 333/260 X |
| 4,656,441 | 4/1987 | Takahashi et al. | 333/260 X |
| 4,672,388 | 6/1987 | Grim | 333/21 A X |
| 4,679,009 | 7/1987 | Cloutier | 333/21 A |

FOREIGN PATENT DOCUMENTS

| | | | |
|---|---|---|---|
| 614483 | 7/1978 | U.S.S.R. | 333/33 |

*Primary Examiner*—Paul Gensler

[57] ABSTRACT

This invention is a rotatable transmission line junction with an external rotary mechanical energy coupling it finds application in microwave polarization rotators, rotary joints, resolvers, amplitude modulators, and other devices. The rotatable conductor of the transmission line coupling is mechanically connected to devices outside of the transmission line system without electrically coupling to the outside in this manner, rotary energy and/or positional information may be input to and/or received from the coupled line. The device consists of the junction of a first transmission line and a second transmission line in which said second transmission line is coupled electrically to said first line and mechanically supported by and/or connected to a plastic rod. Said plastic rod also passes to the outside of the transmission line system to form a mechanical rotational coupling means for the coupled line. Either line may be considered to be input or output. The preferred embodiment is for the junction of said two lines at 90°, although almost any angle may be accommodated. The preferred embodiment is in the form of the junction of two coaxial transmission lines. However, other transmission line forms may be joined with the device. For example, one could join two micro strip type lines or a micro strip line and a coaxial line. These transmission lines may be in turn be connected to other devices; such as waveguides, feed horns, or coaxial connectors; to make a polarization rotator, a rotary joint, resolver, amplitude modulator, or other device.

8 Claims, 3 Drawing Sheets

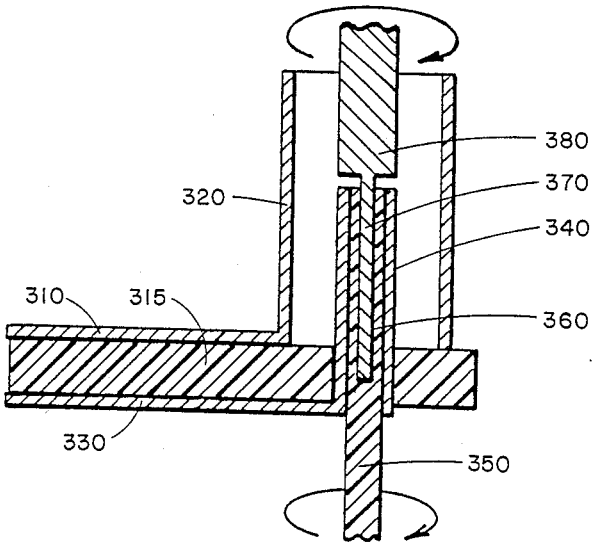
FIG. 3-A
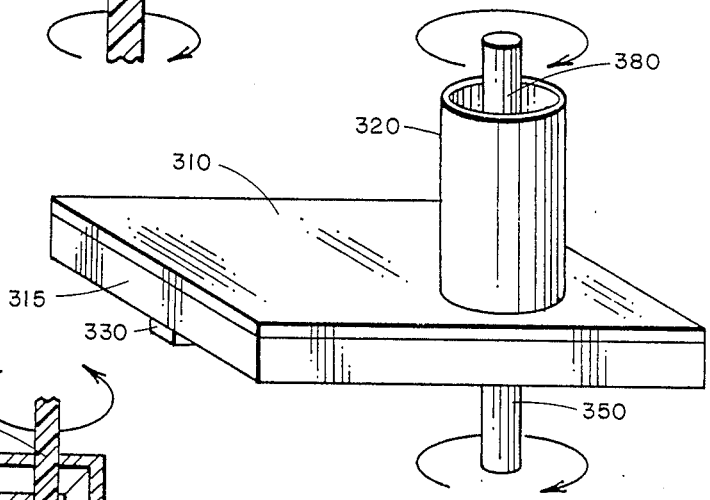
FIG. 3-B
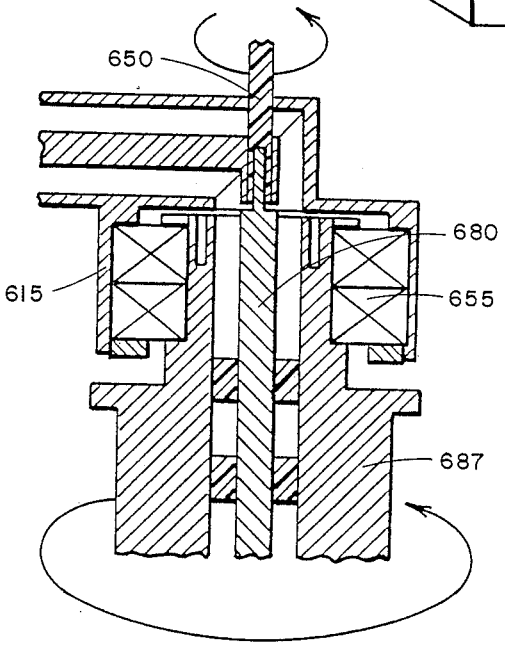
FIG. 6

MICROWAVE ROTARY JUNCTION WITH EXTERNAL ROTARY ENERGY COUPLING

BACKGROUND

1. Field of Invention

This invention relates to transmission line coupling devices for high frequency transmission lines, such as used for microwaves. Particularly, the invention relates to rotatable transmission line coupling in which the rotatable member is mechanically coupled to the outside of the transmission line system for performing a variety of functions. Typical applications are that of a waveguide coupling which rotates the plane of polarization of the waves transmitted through the device by external rotary energy source means, or the rotary coupling of a rotary joint that provides rotational position of the coupled line to external rotary position sensing means.

2. Description of Prior Art

Many different arrangements have been used to mechanically rotate the plane of polarization of a transmitted high frequency wave. For example, the amplitude modulator disclosed in the patent to Murphy U.S. Pat. No. 2,880,399, and the rotary polarization coupling disclosed in the patent to Augustin U.S. Pat. No. 4,528,528, and many patents divulging differing linear polarization coupling probe shapes in the circular waveguide of devices patented after Augustin. However, all of these devices have a rectangular waveguide orthogonal to a circular waveguide such that the symmetric rotation of the probe in the rectangular waveguide causes the other end of the probe in the circular waveguide to rotate to the desired polarization. The rotary energy is coupled by external means, by direct contact with the polarizing probe in the case of Murphy, and by a plastic insulator in the case of Augustin.

All of these prior devices require that the rectangular waveguide have a specific orientation with respect to the circular waveguide; namely, they must be orthogonal to each other and with their axes intersecting. None of the previous devices lend themselves to the direct coupling to an external coaxial transmission line without an intervening waveguide type transmission line.

The previous devices are all necessarily larger because of their requirement for a rectangular waveguide.

All of the previous polarization type devices define a specific probe shape in the circular waveguide or specific circular waveguide characteristic.

None of the previous devices lend themselves to direct coupling to coaxial line or other transmission line forms without an intervening rectangular waveguide type transmission line.

In the case of a rotary joint type device, no prior art was found in which the coupled coaxial line center conductor is mechanically coupled to external position sensing means.

All of the previous devices described a system rather than a fundamental element with a wide variety of applications.

OBJECTS AND ADVANTAGES

Accordingly, I claim the following as my objects and advantages of the invention: to provide a microwave rotary junction capable of driving or being driven by external means, and functioning as an ordinary transmission line element in so far as connection to other device, transmission lines, or for the purpose of impedance matching of the device.

It is a general object of this invention to provide an improved rotary coupling for use in transmission lines, and particularly in microwave transmission. A feature of this invention is to provide a rotary coupling in which the coupled member can be freely rotated without affecting the transmission characteristics of the transmission line, and this rotatable member has external mechanical rotational connection means. This free rotation and mechanical coupling without affecting the junction's transmission characteristics can be used to precisely drive the coupled line from external means, or it can be used to precisely sense the rotational position of the coupled line through external means, or both of these functions simultaneously. These functions may be achieved in a simple and compact unit.

It is another feature of this invention to provide a mechanical rotation path that is different from the microwave signal path.

A still further feature of this invention is that the coupled lines may have their longitudinal axes intersecting at virtually any angle, although the 90° intersection gives the most flexibility in connection to external mechanical devices.

A still further feature of this invention is to provide a microwave transmission line rotator which is readily controlled by external means.

A still further feature of this invention is to provide a microwave transmission line rotator which is readily capable of coupling positional information to external devices.

A still further feature of this invention is to provide a transmission line rotary coupling which is impedance matched for all orientations of rotation over a wide band of frequencies.

A still further feature of this invention is to provide lossless coupling between the transmission line segments.

A still further feature of this invention is to provide a transmission line rotary coupling with external rotary mechanical coupling, independent of the electrical coupling means.

A still further feature of this invention is to provide a transmission line rotary coupling element which is compact and self contained and has the ability to be readily adjusted for a specific rotary orientation.

A still further feature of this invention is to provide a transmission line rotary coupling assembly in which the coupling is independent of the input device, or the output device, or the mechanical device attached to it to determine and/or control its specific rotary orientation.

A still further feature of this invention is to provide mechanical coupling without affecting the electrical coupling.

For polarization type coupling, this present device neither requires the input section and output section axes to be orthogonal , nor does it require waveguides be used in the coupling. For the case of a polarization rotator this allows greater flexibility in the orientation of the rectangular waveguide with respect to the circular waveguide, and in an embodiment, eliminates a ninety degree bend in the rectangular waveguide to allow propagation in the same direction as or in a direction orthogonal to the direction of the circular waveguide. The drive by external means may precisely select any linear polarization in the circular waveguide and couple it to the rectangular waveguide.

In an alternate embodiment, the selected polarization signal may be coupled into a coaxial transmission line or connector without the need for a second waveguide.

The transmission line rotary junction with external mechanical coupling is the subject of the invention, and not the coupling probe configuration used in the cylindrical waveguide to achieve a desired polarization in the case of application to a polarizer. Indeed, many shaped probes, including those of Murphy, Augustin, Gould and a myriad of other unreported shapes have provided satisfactory operation, using on the end opposite the circular waveguide either a coaxial connector or a rectangular waveguide.

In the case of a gimbal, this invention allows the direct connection of the gimbal position sensing device without the need for gears or slip rings.

DESCRIPTION OF THE DRAWINGS

FIGS. 3A and 3B are a perspective view and a cutaway view of a micro-strip embodiment of the invention.

FIG. 6 is an embodiment as a rotary junction in a gimbal which requires no data gear or slip rings.

DESCRIPTION OF THE INVENTION

Figure 1:
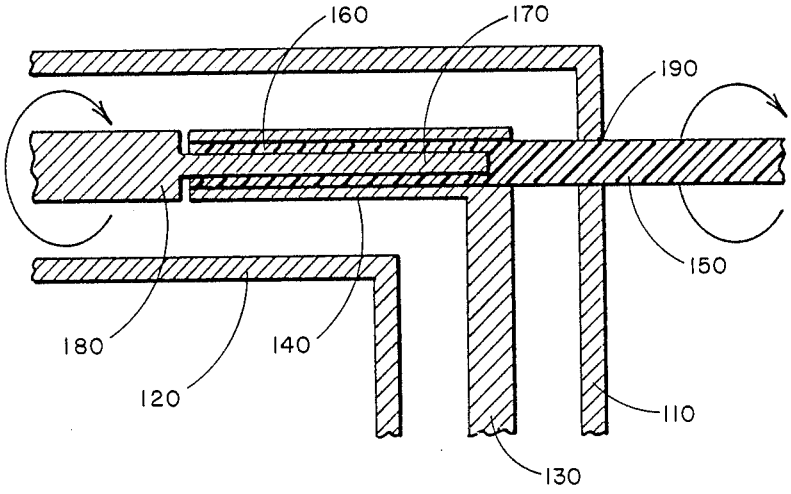
FIG. 1 is a cut away view of a coaxial line embodiment of the invention utilizing a quarter wave choke section junction.

Referring to FIG. 1, a preferred embodiment of the invention consists of a hollow circular tube 110 intersecting a second hollow circular tube 120 in the manner of a coaxial transmission line junction outer conductor. Within this outer conductor and mounted concentrically to it is a two legged or sectioned center conductor 130–140 having one leg 130 concentric with the first section of outer conductor 110 and the second leg 140 concentric with the the second leg 120 of the outer conductor. This second leg of the center conductor 140 is comprised of a hollow cylinder. This hollow center conductor has both ends open. Disposed within the hollow center conductor is a dielectric support rod and drive 150 having at least a portion 160 contained within the hollow center conductor segment 140 also hollow. Contained within this hollow dielectric 160 is the end portion 170 of a second center conductor 180. The overlapping is approximately one quarter wavelength long at the mid-band frequency of the desired frequency band of operation. This second center conductor is contained within and captured by the hollow dielectric section 160. The dielectric is free to rotate within the hollow center conductor section 140. The dielectric 150 passes through the outer conductor 110 through a hole 190 of size sufficiently small so as to preclude electrical coupling between the region with the coaxial line segment and the region without the coaxial line segment 110. Rotation of the drive section 150 causes the center conductor 180 to rotate in kind, and vice-versa. Thus the center conductor can be precisely driven to any rotational angle by external means, or the center conductor can position an external sensing device to indicate its precise rotational position. The transmission line segment 140–160–170 forms a noncontacting capacitive choke coupling between the two sections of the transmission line segment. The transmission line behaves in the usual manner for transmission lines, as does the choke. The design of the choke section is the same as that of any known open circuit terminated quarter wave choke as described in several textbooks on transmission lines; for example, M.I.T. Rad. Lab. Series, Vol 9, pp 100–114.

The plastic support and drive rod 160 should be of a low loss dielectric material with high strength such as Ultra High Molecular Weight Polyethylene (UHMW) or polypropylene.

Figure 2:
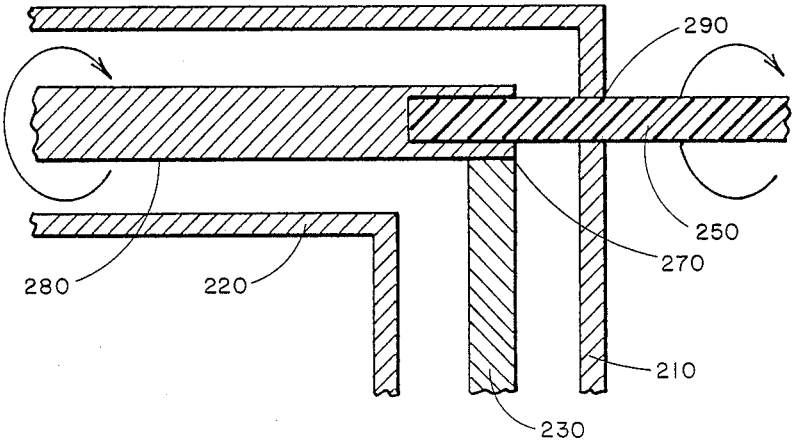
FIG. 2 is a cut away view of a coaxial line embodiment of the invention utilizing a contacting junction.

FIG. 2 is a cut away drawing of the invention in an alternate embodiment wherein the junction between the stationary leg and the driven leg 270 is a contacting type junction as opposed to a choke type junction.

In the FIG. 2 embodiment, the invention consists of a hollow circular tube 210 intersecting a second hollow circular tube 220 in the manner of a coaxial transmission line junction outer conductor. Concentrically located within the first outer conductor 210 is a first center conductor 230. This first center conductor 230 is in electrical contact with a second center conductor 280. This second center conductor 280 is concentrically located with respect to the second segment of the outer conductor 220 and free to rotate within this outer conductor section. A plastic rod 250 is connected to the rotatable conductor 280 and rotationally fixed with respect to said conductor. The plastic rod passes through the outer conductor 210 through a hole 290 of size sufficiently small so as to preclude electrical coupling between the region within the coaxial line segment and the region without the coaxial line segment 210. Rotation of the plastic rod 250 causes the center conductor 280 to rotate in kind, and vice-versa. Thus the center conductor can be precisely driven to any rotational angle by external means, or the center conductor can position an external sensing device to indicate its precise rotational position. The transmission line junction 270 forms a contacting coupling between the two sections of the transmission line segment. The transmission line behaves in the usual manner for transmission lines. The design of the contacting junction is the same as that of any contacting type junction and may use, for example, spring fingers, or precious metal friction contact.

FIG. 3A and FIG. 3B are another embodiment of the invention wherein the transmission line types are a micro-strip segment and a coaxial line segment. Referring to FIG. 3A and FIG. 3B, the micro-strip section comprises a ground plane 310 and a strip conductor 330 separated by a dielectric 315. The ground plane has a hollow circular metal tube 320 affixed to it in the manner of a coaxial transmission line outer conductor. The strip conductor 330 is terminated with a smaller hollow metal tube 340 that passes through the dielectric and is concentrically located within the outer conductor 320 to form a coaxial transmission line segment. A hollow plastic rod 350 is contained within the inner conductor tube 340 and is free to rotate within said conductor. The hollow section 360 of plastic rod 350 contains a second coaxial center conductor 380 that is rotationally fixed with respect to the plastic rod, but free to rotate within the outer conductor 320. The overlap section 370 of the second conductor 380 and the plastic rod section 360 and the hollow tube 340 form a quarter wave choke coupling. The plastic rod 350 may be connected to external means for determining rotational position of the coupled transmission line 380 or for coupling mechanical energy to the transmission line to precisely rotationally position said line, or both functions simultaneously. The transmission line segments are designed by normal transmission line techniques as is the choke section.

Figure 4:
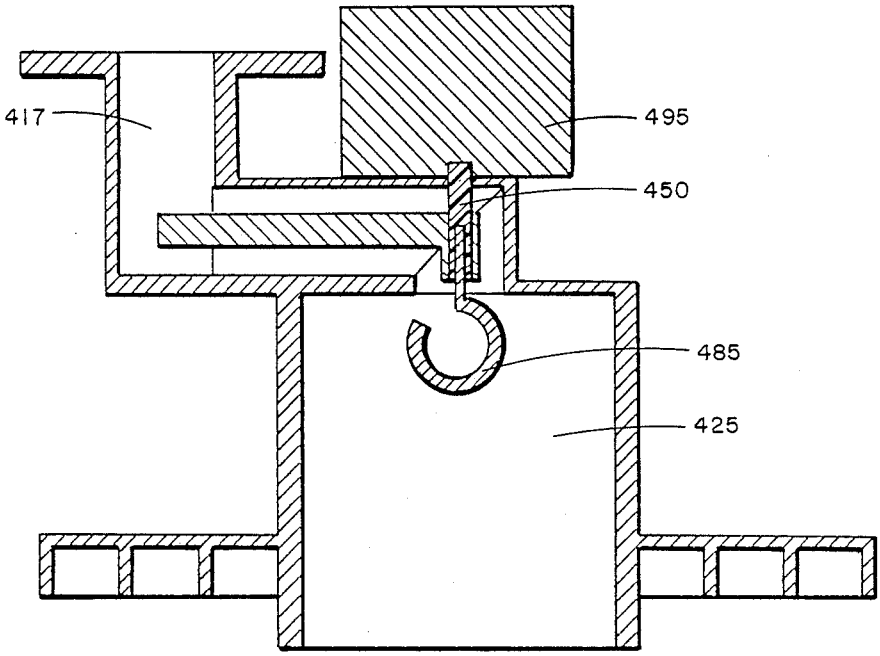
FIG. 4 is a preferred embodiment of the device to a microwave polarization rotator having rectangular waveguide input, with the rectangular waveguide orthogonal to the circular waveguide.

FIG. 4 depicts an embodiment of the device of FIG. 1 as a polarization rotator. The drive rod 450 is coupled to an accurate positioning device, such as a servo-drive motor or a stepper motor 495. The driven coaxial center conductor is continued into a circular waveguide section 425 and formed into a polarization sensitive probe 485. The desired polarization to be coupled through the device may be readily selected by the external drive. The fixed polarization end of the device is terminated in a rectangular waveguide 417. The orientation shown in the figure is in line with the circular waveguide 425. However, the attitude of the rectangular waveguide is limited only by the type of waveguide to coaxial junction selected.

Figure 5:
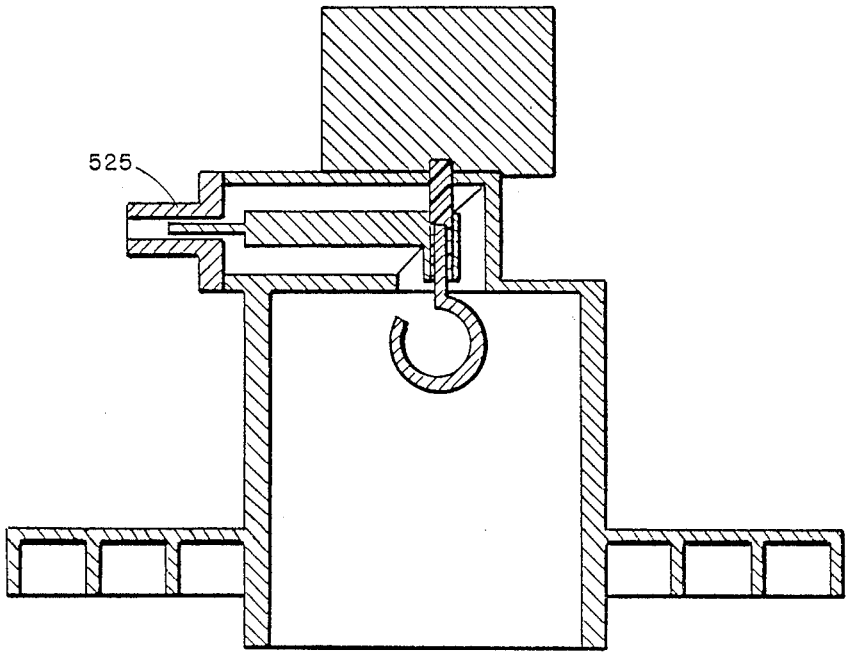
FIG. 5 is another preferred embodiment in the application of a microwave polarization rotator using a coaxial connector instead of a rectangular waveguide on the fixed polarization end.

FIG. 5 is an embodiment of the invention in a polarizer wherein the fixed polarization end is terminated in a connector 525 instead of a waveguide. This connector could just as well be a direct connection to a microwave device such as an amplifier, mixer, or down-converter.

FIG. 6 is an embodiment of the invention into a rotary junction for an antenna gimbal or similar application wherein the gimbal position may be coupled to external position sensing means without the need for gears or slip rings for the positional data. In FIG. 6, the rotatable section 687 is supported by bearings 655 allowing rotation with respect to the outer shell 615. The rotatable section 687 is used to form the axle of the gimbal and is driven by rotary energy means about the rotatable axle which also forms the coupled transmission line outer conductor. The rotatable inner conductor 680 is fixed with respect to the outer conductor such that rotation of the axle causes said inner conductor, and hence the plastic rod 650 to rotate. The plastic rod is connected to external position sensing means to accurately determine the position of the gimbal.

I claim:

1. A microwave rotary junction with mechanical energy coupling means comprised of a first, stationary, TEM type transmission line and a second TEM type transmission line having a rotatable center conductor, said rotatable center conductor having a first end and a second end and said rotatable center conductor being choke coupled to a stationary conductor of said first TEM transmission line so that said first end extends beyond said stationary conductor of said first transmission line and said second end is an open circuit on said second coaxial TEM line and wherein said rotatable center conductor is connected by a dielectric rod extending from said second end of said rotatable center conductor to the outside of said first transmission line to form a drive for performing at least one of the following energy coupling means: a- driving said rotatable transmission line conductor by external means; and b- driving an external device by said rotatable transmission line conductor.

2. The microwave rotary junction of claim 1 wherein said first TEM type transmission line is comprised of a coaxial transmission line, said first coaxial transmission line having an outer conductor and an inner conductor comprising the stationary conductor of said line and said second TEM type transmission line is comprised of a second coaxial transmission line and said dielectric rod passing through the outer conductor of said first coaxial transmission line to said rotary energy coupling means for rotating said dielectric rod and said rotatable center conductor rotationally fixed to said dielectric rod.

3. The microwave junction of claim 1 wherein said choke coupling comprises a quarter wave choke section formed between said stationary conductor which forms a hollow choke outer conductor and between said rotatable center conductor which forms a choke inner conductor, one end of said hollow choke outer conductor forming an open circuit with said choke inner conductor wherein said choke inner conductor is held by said dielectric rod within said choke outer conductor and said dielectric rod extends outside of said first stationary transmission line to said rotary energy coupling means.

4. The microwave junction of claim 1 wherein said rotatable center conductor extends into a first waveguide having both, a symmetric cross section, and the capability of propagating orthogonal TE modes, such that the outer conductor of said second TEM type transmission line is centered on and extends from the rear wall of said waveguide, and said rotatable center conductor extension into said first waveguide forms an electrical mode coupling probe between said second TEM type transmission line and said first waveguide such that the polarization vector within said symmetric cross section waveguide is established by the rotational position of said electrical coupling probe extension of said rotatable center conductor.

5. The microwave junction of claim 1 wherein a first end of said stationary conductor of said first transmission line is coupled to said rotatable center conductor and a second end of said stationary conductor is connected to a rectangular waveguide in the form of a coaxial line to rectangular waveguide transformer.

6. The microwave junction of claim 1 wherein said stationary transmission line is connected to external microwave signal processing means.

7. The microwave rotary junction of claim 1 wherein said first TEM type transmission line is comprised of a microstrip transmission line, said microstrip transmission line having a ground plane conductor on one side of a dielectric sheet and a thin conductor on the opposite side of said dielectric sheet, and said second TEM type transmission line is comprised of a coaxial transmission line, said rotatable center conductor coupling to and having said first end extending beyond a hollow tube section attached to said stationary line thin conductor, and said rotatable center conductor being connected to and rotationally fixed with respect to said dielectric rod which extends from said second end of said rotatable center conductor and said dielectric rod continuing to the outside of said first microstrip transmission line to rotary energy coupling means.

8. The microwave junction of claim 1 wherein said second transmission line is a coaxial transmission line comprised of an outer conductor and a rotatable center conductor and wherein said outer conductor of said second transmission line is fixed with respect to said rotatable center conductor of said second transmission line, thereby rotating with said rotatable center conductor.

* * * * *